United States Patent [19]

Beck

[11] 4,141,503

[45] * Feb. 27, 1979

[54] NOZZLE ASSEMBLY WITH ADJUSTABLE ORIFICE

[76] Inventor: Louis Beck, c/o Beck Chemicals, 3350 W. 137th St., Cleveland, Ohio 44111

[ * ] Notice: The portion of the term of this patent subsequent to Oct. 19, 1993, has been disclaimed.

[21] Appl. No.: 806,548

[22] Filed: Jun. 14, 1977

Related U.S. Application Data

[60] Continuation-in-part of Ser. No. 705,513, Jul. 15, 1976, Pat. No. 4,033,512, which is a division of Ser. No. 610,656, Sep. 5, 1975, Pat. No. 3,986,673.

[51] Int. Cl.[2] ..... B05B 7/00

[52] U.S. Cl. ..... 239/394; 239/423; 239/544

[58] Field of Search ..... 239/417.5, 420, 423, 239/426, 394, 552, 460, 543, 544

[56] References Cited

U.S. PATENT DOCUMENTS

| | | | |
|---|---|---|---|
| 590,526 | 9/1897 | Jarre et al. | 239/543 |
| 1,144,816 | 6/1915 | Cowper | 239/493 |
| 1,494,020 | 5/1924 | Riehm | 239/543 X |
| 1,873,321 | 8/1932 | Elder | 239/538 X |

*Primary Examiner*—John J. Love

*Attorney, Agent, or Firm*—McNenny, Pearne, Gordon, Gail, Dickinson & Schiller

[57] ABSTRACT

A nozzle assembly includes a stem and a cap. The stem includes two passages for carrying the same liquid or different liquids under high pressure. The passages terminate at a conical end surface of the stem. The cap is seated on the end surface of the stem and cooperates with the end surface of the stem to define two nozzle openings or orifices. The cap is arranged so that rotation of the cap on the stem changes the size of the orifices.

19 Claims, 8 Drawing Figures

Fig. 3
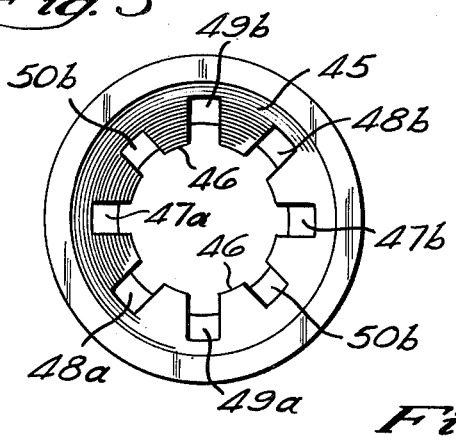
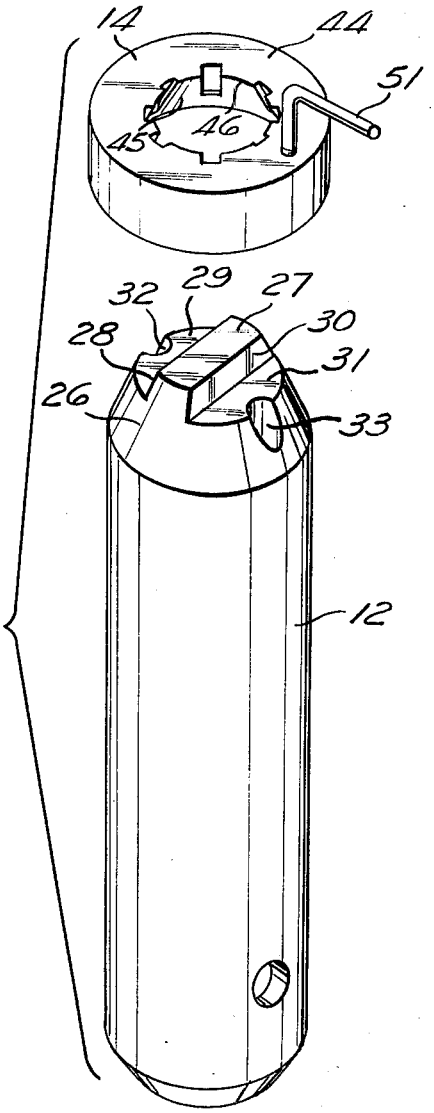
Fig. 4
Fig. 1
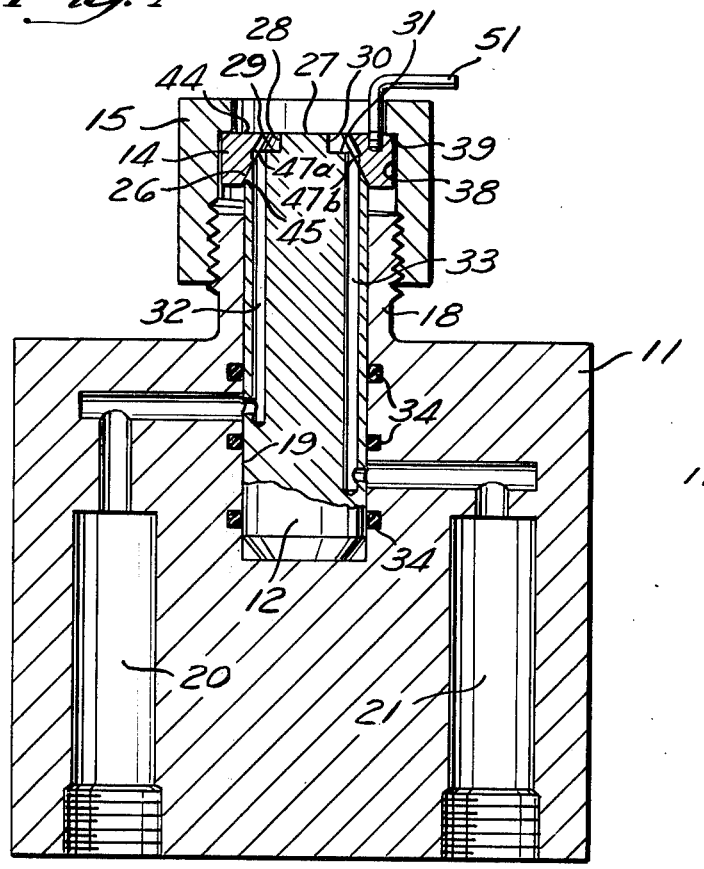
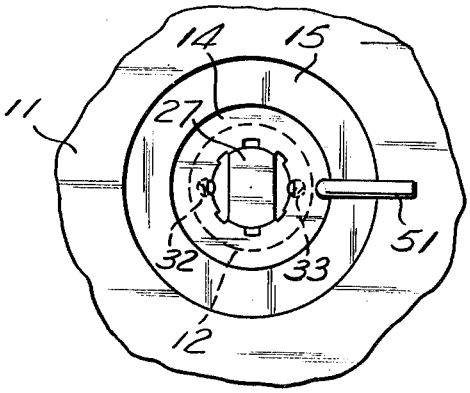
Fig. 2

NOZZLE ASSEMBLY WITH ADJUSTABLE ORIFICE

BACKGROUND AND SUMMARY OF THE INVENTION

This application is a continuation-in-part of U.S. patent application Ser. No. 705,513, filed July 15, 1976 now U.S. Pat. No. 4,033,512, which in turn is a divisional of application Ser. No. 610,656, filed Sept. 5, 1975, now U.S. Pat. No. 3,986,673. U.S. Pat. No. 3,986,673 is incorporated by reference as though fully set out herein.

The present invention relates to nozzles for airless paint sprayers. The invention provides a nozzle assembly in which the size of the nozzle opening or orifice is adjustable. As used herein, the term "nozzle opening" or "nozzle orifice" refers to the cross-sectional area at the tip of the nozzle assembly measured in a plane perpendicular to the flow of fluid through the nozzle assembly. The tip of the nozzle assembly is the location at which the nozzle assembly no longer fully confines the fluid flowing through the nozzle assembly.

According to the present invention, a nozzle assembly is provided which mixes two separate liquids externally of the nozzle and which can change the nozzle orifice for each of the liquids. The two liquids can be either of the same or of different composition. The invention finds particular application when the size of the nozzle orifice must be reduced due to wear of the nozzle orifice caused by the high velocity and abrasive content of the liquid which is being sprayed, when the relative amounts of the two liquids which are being sprayed is to be changed, and when spraying of one of the two liquids is to be terminated while spraying of the other liquid is to continue.

According to the principles of the invention, the nozzle assembly includes a stem and a cap. The stem includes two passages for carrying the same or separate fluids under pressure. The passages terminate at a conical end surface of the stem.

The cap has a matching conical surface which is seated on the end surface of the stem. Grooves in the matching conical surface of the cap extend from a location at which the passages in the stem terminate and cooperate with the stem to define a nozzle orifice for each of the passages in the stem. By rotating the cap relative to the stem, different grooves in the matching conical surface of the cap are aligned with the passages in the stem to change the size of the nozzle orifice.

BRIEF DESCRIPTION OF THE DRAWINGS

These and other aspects and advantages of the invention will be apparent to those skilled in the art upon an understanding of the preferred embodiment of the invention shown in the drawings, wherein:

FIG. 1 is a cross-sectional side elevational view of a nozzle assembly according to the principles of the invention;

FIG. 2 is a partial top plan view of the nozzle assembly shown in FIG. 1;

FIG. 3 is a bottom plan view of the cap for the nozzle assembly shown in FIG. 1;

FIG. 4 is an exploded perspective view of the stem and the cap for the nozzle assembly shown in FIG. 1;

DETAILED DESCRIPTION OF THE DRAWINGS

Figure 5:
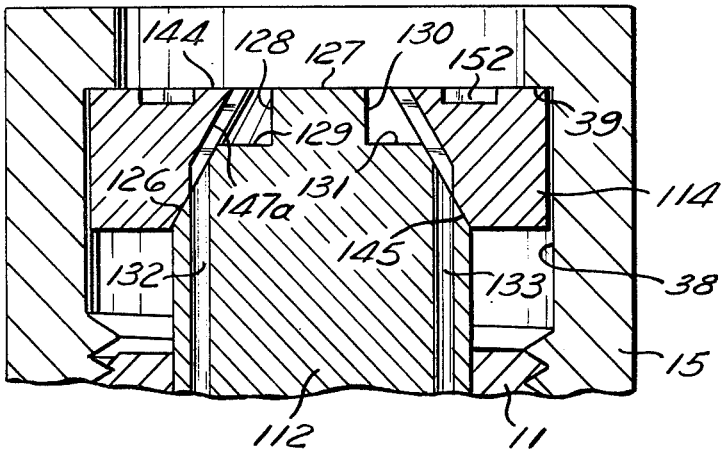
FIG. 5 is a view similar to FIG. 1 showing a second embodiment of the invention.

Referring now to the drawings in greater detail, FIG. 1 shows a nozzle assembly which includes a body 11, a stem 12, a cap 14, and a retainer ring 15.

The body 11 is adapted to be mounted on an airless paint spray gun (not shown) which supplies two sources of high pressure liquid to the body 11. The body 11 includes a threaded extension 18 and a blind bore 19 which extends through the extension 18. First and second fluid flow through passages 20 and 21 extend into the body 11 and communicate with the blind bore 19 at axially spaced locations.

Referring to FIGS. 1 and 4 together, the stem 12 is received in the blind bore 19 of the body 11. The stem 12 has an upper end which is provided with a tapered or conical surface 26 which terminates at a flat radial end face 27. A portion of the upper end of the stem 12 is cut away to provide a first axial wall 28 and radial wall 29 and a second axial wall 30 and radial wall 31. A first stem passage 32 extends axially from the intersection of the wall 29 and the conical surface 26, and a second stem passage 33 extends axially from the intersection of the wall 31 and the conical surface 26. The first stem passage 32 is in open pressure communication with the first fluid flow passage 20 of the body 11, and the second stem passage 33 is in open pressure communication with the second fluid flow passage 21 in the body 11. Suitable O-ring seals 34 prevent mixing or leakage of the liquids which flow through these passages under high pressure as described further below.

Referring again to FIG. 1, the retainer ring 15 includes an opening 38 extending therethrough. The opening 38 includes a threaded portion which is threadably secured to the extension 18 on the body 11 and an annular shoulder 39 which acts against the cap 14 to retain the cap 14 and stem 12 in the positions shown in FIG. 1.

Referring now to FIGS. 1 through 4 together, the cap 14 is annular and includes a radial end face 44 which is coplaner with the radial end face 27 of the stem 12. A matching tapered or conical surface 45 of the cap 14 is seated on the conical surface 26 of the stem 12. The intersection of the radial end face 44 and the conical surface 45 of the cap 14 provides a sharp edge 46.

The tapered or conical surface 45 of the cap 14 is provided with a first pair of nozzle surfaces **47*a* and 47*b*. The nozzle surfaces 47*a* and 47*b* are in the form of identical shallow grooves in the conical surface 45 and have a substantially uniform cross section in a plane perpendicular to the path of liquid flow described below. The nozzle surface 47*a* of the cap 14 cooperates with the first passage 32 and conical surface 26 of the stem 12 to define a first nozzle orifice having a predetermined cross-sectional area. Similarly, the nozzle surface 47*b* cooperates with the second passage 33 and conical surface 26 of the stem 12** to form a second nozzle orifice of predetermined cross-sectional area. In the preferred embodiment, these nozzle orifices defined in part by the surfaces 47*a* and 47*b* are of identical cross-sectional area.

As seen in FIGS. 2, 3 and 4, the cap 14 also has a second pair of nozzle surfaces consisting of surfaces 48*a* and 48*b*, a third pair of nozzle surfaces consisting of surfaces 49*a* and 49*b*, and a fourth pair of nozzle surfaces consisting of surfaces 50*a* and 50*b*.

The second nozzle surfaces 48*a* and 48*b*, like the first nozzle surfaces 47*a* and 47*b*, are in the form of identical shallow grooves in the conical surface 45 so that nozzle openings or orifices of identical cross-sectional area are formed when the surfaces 48*a* and 48*b* are aligned with the passages 32 and 33. However, the grooves forming the second nozzle surfaces 48*a* and 48*b* are more shallow than the grooves forming the first nozzle surfaces 47*a* and 47*b*. The third nozzles surfaces 49*a* and 49*b* are also in the form of shallow grooves in the conical surface 45, but the groove forming the surface 49*a* is slightly deeper than the groove forming the surface 49*b* so that the nozzle orifice formed when the surface 49*a* is aligned with the passage 32 is slightly larger than the nozzle orifice formed when the surface 49*b* is aligned with the passage 33. The fourth nozzle surfaces 50*a* and 50*b* are also in the form of grooves in the conical surface 45, and the groove forming the surface 50*a* is not as deep as the groove forming the surface 50*b* so that the nozzle orifice formed when the surface 50*a* is aligned with the passage 32 is smaller than the nozzle orifice formed when the surface 50*b* is aligned with the passage 33.

The grooves which define the nozzle surfaces 47, 48, 49 and 50 in the preferred embodiment each have straight sides and a curved bottom, although grooves which are curved and which do not have the straight sides may also be utilized. The depth of the grooves which define the nozzle surfaces 47, 48, 49 and 50 is exaggerated in the drawings for clarity.

A small handle 51 is threadably received in a threaded hole in the top surface of the cap 14 to provide a convenient projection which can be grasped by the operator to rotate the cap 14 when the retainer ring 15 is loosened.

When two liquids are to be sprayed and mixed with the nozzle assembly shown in FIGS. 1 through 4, the nozzle assembly is attached to a spray gun (not shown) which supplies high pressure liquid to each of the fluid flow passages 20 and 21. The two liquids which are supplied to the passages 20 and 21 may be of the same or different composition, and may be two different colors of paint, or an epoxy resin and hardener, or an isocyanate and a polyol of a polyether type polyurethane foam, or any other suitable liquids.

The two liquids are isolated from one another in the nozzle assembly so that they can not mix together in the nozzle assembly. The first liquid flows through the passage 20 in the body 11 and through the passage 32 in the stem 12. At the forward end of the stem 12, the liquid in the passage 32 flows out of the nozzle opening or orifice which is cooperatively defined by the nozzle surface 47*a* of the cap 14 and the conical surface 26 and passage 32 of the stem 12. The first liquid, in the form of a fine spray, projects forward and to the right as viewed in FIG. 1. Similarly, the second fluid flows through the second passage 21 of the body 11 and through the second passage 33 of the stem 12. The liquid reaches the nozzle opening or orifice which is cooperatively defined by the nozzle surface 47*b* and by the conical surface 26 and passage 33 and is projected to the left and forward of the nozzle assembly as viewed in FIG. 1. The two liquids converge and impinge upon one another at a point forward of the nozzle assembly as viewed in FIG. 1, so that mixing of the two liquids occurs externally of the nozzle assembly.

Because the grooves forming nozzle surfaces 47*a* and 47*b* are identical, the nozzle orifices formed at the termination of the passages 32 and 33 are of identical cross section and the resulting spray consists of equal parts of the liquid which is pumped through the passage 32 and the liquid which is pumped through the passage 33.

When it is desired to provide a smaller nozzle opening for the liquids flowing through the passages 32 and 33, the retainer 15 is loosened to permit the cap 14 to be rotated by the handle 51. The cap 14 is so rotated until the more shallow nozzle surfaces 48*a* and 48*b* are brought into axial alignment with the passages 32 and 33. By this arrangement, the size of the nozzle orifice for each of the two liquids which are sprayed can be changed. This would be done when the first used nozzle surfaces become worn so that the size of the nozzle orifices is undesirably increased, or when liquids of a different composition or viscosity are to be sprayed.

When it is desired to provide a larger nozzle orifice for the passage 32 and a smaller nozzle orifice for the passage 33, the nozzle surface 49*a* is aligned with the passage 32 and the nozzle surface 49*b* is aligned with the surface 33. Because the groove which forms the nozzle surface 49*a* is larger than the groove which forms the nozzle surface 49*b* as described above, this arrangement provides a larger nozzle orifice for the passage 32 and a smaller nozzle orifice for the passage 33. In a similar manner, when it is desired to provide a smaller nozzle orifice for the passage 32 and a larger nozzle orifice for the passage 33, the cap 14 is rotated so that the nozzle surface 50*a* is aligned with the passage 32 and the nozzle surface 50*b* is aligned with the passage 33. In this manner, the relative sizes of the nozzle orifices for the passages 32 and 33 can be changed. This can be done when it is desired to change the relative amounts of the two liquids to provide a spray having a greater amount of the liquid flowing through the passage 32 or a greater amount of the liquid flowing through the passage 33.

Figure 6:
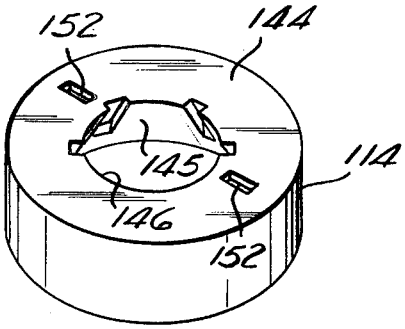
FIG. 6 is a perspective view of the cap for the nozzle assembly shown in FIG. 5.
Figure 7:
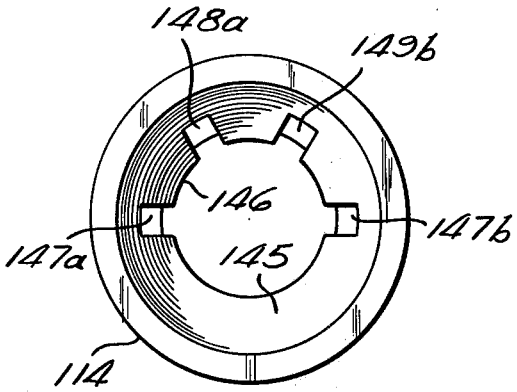
FIG. 7 is a bottom plan view of the cap for the nozzle assembly shown in FIG. 5.

Referring now to FIGS. 5 through 7, a second embodiment of the invention is shown. In the second embodiment, the body 11 and retainer ring 15 are unchanged.

The second embodiment of the invention provides a stem 112 having a conical surface 126 and radial end face 127, axial walls 128 and 130, and radial walls 127 and 129, all of which are identical to corresponding portions of the stem 12 shown in FIGS. 1 through 4. The stem 112 also includes a first stem passage 132 and a second stem passage 133 which are identical to the corresponding parts of the stem 12 of the first embodiment, except that the passages 132 and 133 are arranged so that they intersect the conical surface 126 and do not intersect the radial walls 129 and 131.

The second embodiment of the invention shown in FIGS. 5 through 7 also includes a cap 114 having a radial end face 144 and a conical surface 145 which met to define a sharp edge 146. The cap 114 also includes a first set of nozzle surfaces consisting of the surfaces 147*a* and 147*b*. This first pair of nozzle surfaces is identical to the first pair of nozzle surfaces 47*a* and 47*b* of the cap 14 shown in FIGS. 1 through 4. The cap 114 also includes a second nozzle surface 148*a* and a third nozzle surface 149*b*.

Figure 8:
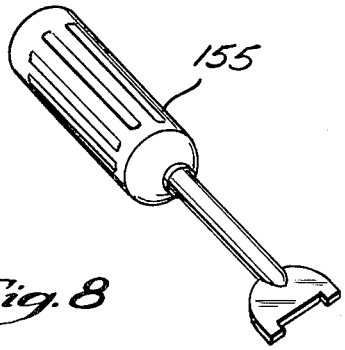
FIG. 8 is a perspective view of a tool used to hold the cap for the nozzle assembly shown in FIG. 5 against rotational movement when the retainer ring is tightened.

Two shallow notches 152 in the end face 144 are provided to receive a screwdriver-like tool 155 shown in FIG. 8 for rotating the cap 114 when the retainer ring 115 is loosened.

When the nozzle assembly shown in FIGS. 5 through 7 is used and the nozzle surfaces 147*a* and 147*b* are axially aligned with the stem passages 132 and 133, the two liquids supplied to the passages 132 and 133 are sprayed in the manner described above with reference to FIGS. 1 through 4. When the cap 114 is rotated to a position aligning the nozzle surface 148*a* with the stem passage 132, only the liquid supplied to the first stem passage 132 is sprayed. The liquid supplied to the second stem passage 133 is blocked by the conical surface 145. Similarly, when the cap 114 is rotated so that the nozzle surface 149*b* is axially aligned with the second stem passage 133, liquid from the second stem passage 133 only is sprayed. Under these conditions, the conical surface 145 radially opposite the nozzle surface 148*b* blocks the end of the stem passage 132. In this manner the second embodiment of the invention permits spraying of either or both liquids which are supplied to the stem passages 132 and 133. If desired, the cap 114 can also be provided with additional pairs of nozzle surfaces of the type described above in connection with FIGS. 1-4.

What is claimed is:

1. In a nozzle assembly, a stem and a cap, said stem having a conical surface, a first and a second liquid flow passage extending through said stem and terminating at said conical surface, said cap having a matching conical surface seated on said conical surface of said stem, a first groove in said conical surface of said cap aligned with said first passage, and a second groove in said conical surface of said cap aligned with said second passage.

2. A nozzle assembly as set forth in claim 1, wherein said first passage and said first groove define a first nozzle opening, and said second passage and said second groove define a second nozzle opening.

3. A nozzle assembly as set forth in claim 2, wherein at least one edge of each of said openings is curved.

4. A nozzle assembly as set forth in claim 3, wherein said stem includes a radial wall intersecting said conical surface of said stem and intersecting each of said first and second passages.

5. A nozzle assembly as set forth in claim 2, wherein said stem includes a radial wall intersecting said conical surface of said stem, and said first and second passages each intersect said conical surface of said stem at a location spaced from said radial surface.

6. A nozzle assembly as set forth in claim 1, including retainer means securing said cap on said stem, and adjustment means independent of said retainer means constructed and arranged to rotate said cap relative to said stem to move said first groove away from said first passage and to move said second groove away from said second passage.

7. In a nozzle assembly, a stem and a cap, said stem having a conical surface, a liquid flow passage extending through said stem and terminating at said conical surface, said cap having a matching conical surface seated on said conical surface of said stem, a groove in said conical surface of said cap aligned with said passage, and said passage and said groove cooperatively defining a nozzle opening having a predetermined cross-sectional area, said groove including a groove surface extending in the direction of flow through said liquid flow passage and at an intersecting angle therewith to alter the direction of flow of a fluid exiting from said liquid flow passage.

8. A nozzle assembly as set forth in claim 7, including a second groove in said conical surface of said cap, said second groove being circumferentially spaced on said conical surface of said cap from said first mentioned groove, said cap being rotatable to a first position to align said first mentioned groove and said liquid flow passage for cooperatively defining said first mentioned nozzle opening and to a second position to align said second groove and said liquid flow passage for cooperatively defining a second nozzle opening.

9. A nozzle assembly as set forth in claim 7, including a second liquid flow passage extending through said stem and terminating at said conical surface of said stem at a location spaced from said first mentioned passage, said cap being rotatable to a first position to cause said conical surface of said cap to completely block said second liquid flow passage and to align said groove and said first mentioned liquid flow passage for cooperatively defining said first mentioned nozzle opening and to a second position to cause said conical surface of said cap to completely block said first mentioned liquid flow passage and to align said groove and second liquid flow passage for cooperatively defining a second nozzle opening.

10. A nozzle assembly as set forth in claim 9, wherein said first and second liquid flow passages are substantially parallel to one another and to a longitudinal axis of said conical surface of said stem.

11. A nozzle assembly as set forth in claim 7, wherein said nozzle opening has at least one curved edge.

12. In a nozzle assembly, a stem and a cap, said stem having a conical surface, a liquid flow passage extending through said stem and terminating at said conical surface, said cap having a matching conical surface seated on said conical surface of said stem, a groove in said conical surface of said cap aligned with said passage, and said passage and said groove cooperatively defining a nozzle opening, said stem including a radial wall intersecting said conical surface of said stem, said passage intersecting said radial wall, and said nozzle opening being at the intersection of said passage and said radial wall.

13. In a nozzle assembly, a stem and a cap, said stem having a conical surface, a liquid flow passage extending through said stem and terminating at said conical surface, said cap having a matching conical surface seated on said conical surface of said stem, a groove in said conical surface of said cap aligned with said passage, and said passage and said groove cooperatively defining a nozzle opening, said stem including a radial wall intersecting said conical surface of said stem, said passage being spaced from said radial wall and terminating solely at said conical surface of said stem, and said cap being rotatable to a position in which said conical surface of said cap completely blocks said passage.

14. In a nozzle assembly, a stem and a cap, said stem having an end surface, a first and a second liquid flow passage extending through said stem and terminating at said end surface, said cap having a matching surface seated on said end surface of said stem, a first groove in said matching surface of said cap aligned with said first passage, a second groove in said matching surface of said cap aligned with said second passage, said first passage and said first groove cooperatively defining a first nozzle opening, and said second passage and said second groove cooperatively defining a second nozzle opening.

15. In a nozzle assembly, a stem and a cap, said stem having an end surface at one of its ends, a liquid flow passage extending through said stem and terminating at said end surface, said cap having a matching surface seated on said end surface of said stem, said matching surface of said cap having a plurality of nozzle surfaces, said cap being constructed and arranged to be movable to a first position relative to said stem in which one of said nozzle surfaces is aligned with said liquid flow passage and the other of said nozzle surfaces is spaced from said liquid flow passage, said one nozzle surface and said liquid flow passage cooperatively defining a nozzle opening having a first predetermined cross-sectional area when said cap is in said first position, said cap being constructed and arranged to be movable to a second position relative to said stem in which said other of said nozzle surfaces is aligned with said liquid flow passage and said one of said nozzle surfaces is spaced from said liquid flow passage, said other nozzle surface and said liquid flow passage cooperatively defining a nozzle opening having a second predetermined cross-sectional area when said cap is in said second position, and said first area being different from said second area.

16. In a nozzle assembly, a stem and a cap, said stem having a conical surface at one end, liquid flow passages extending through said stem and terminating at said conical surface, said cap having a conical surface seated on said conical surface of said stem, said conical surface of said cap having a plurality of nozzle surfaces, one of said nozzle surfaces being aligned with each of said passages, and others of said nozzle surfaces being spaced from said passages.

17. A nozzle assembly as set forth in claim 16, wherein each of said nozzle surfaces is a groove in said conical surface of said cap.

18. A nozzle assembly as set forth in claim 17, wherein said grooves providing said aligned nozzle surfaces have a first predetermined cross-sectional area, and said grooves providing said spaced nozzle surfaces have a second predetermined cross-sectional area different from said first area.

19. A nozzle assembly as set forth in claim 16, including retainer means securing said cap on said stem by a threaded connection, and means holding said cap against movement relative to said stem during tightening of said retainer means.

* * * * *